US005246354A

United States Patent [19]

Pardinas

[11] Patent Number: 5,246,354

[45] Date of Patent: Sep. 21, 1993

[54] VALVELESS METERING PUMP WITH RECIPROCATING, ROTATING PISTON

[75] Inventor: Guillermo P. Pardinas, Miami, Fla.

[73] Assignee: Abbott Laboratories, Abbott Park, Ill.

[21] Appl. No.: 648,242

[22] Filed: Jan. 31, 1991

[51] Int. Cl.[5] ..... F04B 7/06

[52] U.S. Cl. ..... 417/500; 417/493; 92/13

[58] Field of Search ..... 417/490, 493, 500; 92/170.1, 13

[56] References Cited

U.S. PATENT DOCUMENTS

| | | | |
|---|---|---|---|
| 2,835,005 | 5/1958 | Green | 417/490 |
| 3,168,872 | 2/1965 | Pinkerton | 417/500 |
| 3,382,812 | 5/1968 | Smith | 417/500 |
| 4,008,003 | 2/1977 | Pinkerton | 417/250 |
| 4,575,317 | 3/1986 | Linder | 417/500 |
| 4,719,844 | 1/1988 | Dugan | 92/170.1 |
| 4,941,809 | 7/1990 | Pinkerton | 417/500 |
| 5,015,157 | 5/1991 | Pinkerton et al. | 417/500 |
| 5,020,980 | 6/1991 | Pinkerton | 417/500 |
| 5,044,889 | 9/1991 | Pinkerton | 417/500 |
| 5,092,037 | 3/1992 | Pinkerton | 417/500 |

*Primary Examiner*—Richard A. Bertsch
*Assistant Examiner*—Charles G. Freay
*Attorney, Agent, or Firm*—Frank S. Ungemach; Priscilla E. Porembski; Daniel W. Collins

[57] ABSTRACT

A valveless metering pump includes a simultaneously reciprocating and rotating piston. The pump head includes radially spaced coplanar ports for drawing and dispensing fluids as the piston rotates sequentially past the ports. The reciprocating stroke of the piston is controlled by adjusting the axis of the piston relative to the drive axis. The pump is designed so that the angular relationship of the ports also can be adjusted relative to the piston to balance the output at the sequential ports. The plurality of adjustments provide a valveless, positive displacement metering pump which is reliable and dependable for dispensing precise volumes of fluid through a plurality of outlet ports.

8 Claims, 5 Drawing Sheets

VALVELESS METERING PUMP WITH RECIPROCATING, ROTATING PISTON

BACKGROUND OF THE INVENTION

1. Field of the Invention

The invention is generally related to valveless metering pumps for delivering precise volumes of fluid and is specifically related to a microfluid pump for precisely dispensing reagents in assay tests.

2. Description of the Prior Art

It is known to use assay testing to determine the presence of infectious diseases such as hepatitis, syphilis and the HIV virus in the presence of blood serum. In a typical procedure, a precise volume of a biological sample is disposed in a test receptacle and a reagent is added to the sample to perform an immunoassay using an automated analyzer. Typically, the reagent is carried on latex microparticles and is delivered in precise volume to the test sample. The reagent volume for each sample can be in the range of 50 to 100 microliters and must be dispensed within a plus or minus 0.5 microliter accuracy and precision and with less than one percent coefficient of variance.

It has become common practice that each pump may deliver a specific reagent to each of one or more test sample locations and, in the prior art, a valve mechanism is used to control the flow of the reagent from first one station and then to the other.

Because of the high precision requirements of pump systems for delivering reagents, the drop size, the condition of the meniscus at the end of the outlet ports and the pressure variation due to valve movement must all be taken into consideration to assure accurate test samples. For example, the minuscule pumping action inherent in shifting a valve from one position to another is of critical significance when dealing with the volumes commonly associated with assay type testing. This, coupled with the requirement that the components of the pump which come into contact with the reagent must be of an inert material such as tetrafluro plastics and/or ceramics or the like has led to very expensive and complex designs. Unfortunately, the more complex the design the greater the likelihood for error in manufacturing and assembly, further increasing the cost by requiring tight tolerances to minimize the effect of tolerance stacking. In addition, more complex systems with the associated number of moving parts contribute to field failure and maintenance cost.

More recently, valveless, positive displacement metering pumps have been successfully employed in applications where safe and accurate handling of fluids is required. The valveless pumping function is accomplished by the simultaneous rotation and reciprocation of a piston in a work chamber. The pump head containing the work chamber and piston is mounted such that is may be swiveled with respect to the rotating drive. The degree of angle controls the stroke and length and in turn, the flow rate. This type of pump has been found to be useful in performing accurate transfers of both gaseous and liquid fluids.

An example of a valveless positive displacement pump is disclosed in U.S. Pat. No. 4,008,003. The pump includes a cylinder divided into a pair of working chambers, each of the chambers communicating with an inlet and an outlet port. The pump disclosed in the U.S. Pat. No. 4,008,003 patent does not lend itself to accurate calibration for metering and dispensing fluids in the precise volumes called for in assay type tests. The piston stroke is not easily adjusted and the angular displacement of the ports cannot be readily calibrated. Another example of a valveless metering pump using a tiltable housing to control the piston stroke disclosed in my co-pending application entitled Pump with Multi-Port Discharge, Ser. No. 07/463,260, filed Jan. 10, 1990, now U.S. Pat. No. 5,015,157 with the co-inventors R. W. Jaekel and D. Pinkerton.

SUMMARY OF THE INVENTION

The valveless metering pump of the subject invention provides a fluid delivery system particularly suited for precision delivery of fluid reagents to a test sample in an assay test in a dependable and reliable manner. The pump design of the subject invention includes a minimum number of moving parts, is valveless, flexible in configuration, and is easy to assemble with minimum risk of tolerance stacking. The pump is of low manufacturing cost and requires minimum field maintenance. The pump is designed to have a broad reagent compatibility and is capable of dispensing fluid volumes in the range of 1–100 microliters per port within plus or minus 0.5 microliters and with a precision of less than one percent coefficient of variance.

The valveless metering pump of the subject invention includes a head having a working chamber made of an inert material for receiving a reciprocating and rotating piston for drawing and dispensing fluids in precise quantities to a plurality of ports in sequential manner. The head and piston is mounted on a pump body which may be tilted angularly relative to the drive spindle for calibrating and adjusting the reciprocating stroke of the piston to precisely meter the fluids dispensed by the pump.

The inlet and outlet ports of the head are in coplanar relationship and are angularly spaced, extending radially outward from the pump working chamber. The angular orientation of the ports may be calibrated relative to the piston to balance the pump action.

In the preferred embodiment, the reciprocating drive is provided by a sleeve enveloping the piston and secured to it by a radial drive pin mounted in a spherical bearing which is free to swivel in any direction as the sleeve and piston are rotated by the spindle of a typical drive motor. By tilting the piston axis relative to the sleeve axis, the reciprocating stroke may be adjusted and calibrated.

The sleeve and piston are carried by a pump housing having one section which is secured in axial alignment with the piston and sleeve and a second section hinged to the first section and in axial alignment with the pump chamber, with means for adjusting and controlling the axial angular displacement between the pump housing and the drive axis for controlling the stroke of the piston as it is rotated by the spindle. In the preferred embodiment, the angle of the piston axis is controlled by adjustment of a single calibration screw.

It is, therefore, an object and feature of the subject invention to provide a valveless, positive displacement metering pump for accurately and precisely dispensing minute volumes of fluid.

It is another object and feature of the invention to provide for a valveless, positive displacement metering pump with single adjustment screw calibration of the piston stroke.

It is yet another object and feature of the subject invention to provide for a valveless, positive displacement metering pump having means for reliably and accurately adjusting the angle between the longitudinal axis of a pump working chamber relative to the longitudinal drive axis of the pump for accurately controlling the reciprocating stroke of a simultaneously reciprocating and rotating piston.

It is an additional object and feature of the present invention to provide a valveless positive displacement metering pump having a plurality of output ports which may be readily balanced with one another.

Other objects and features of the invention will be readily apparent from the drawing and description of the preferred embodiment which follow.

DETAILED DESCRIPTION OF THE PREFERRED EMBODIMENT

Figure 1:
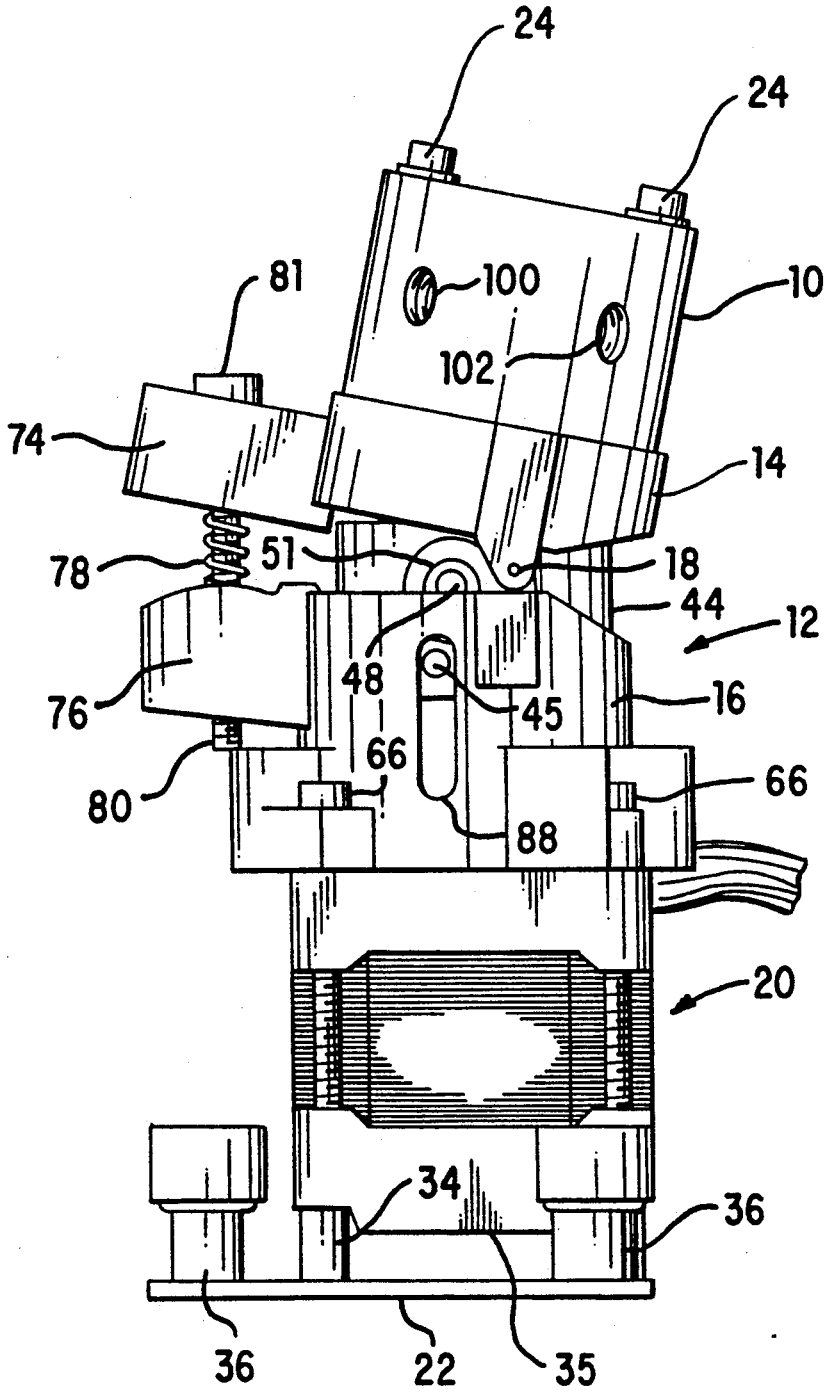
FIG. 1 is a side elevational view of a valveless, positive displacement metering pump in accordance with the present invention.
Figure 2:
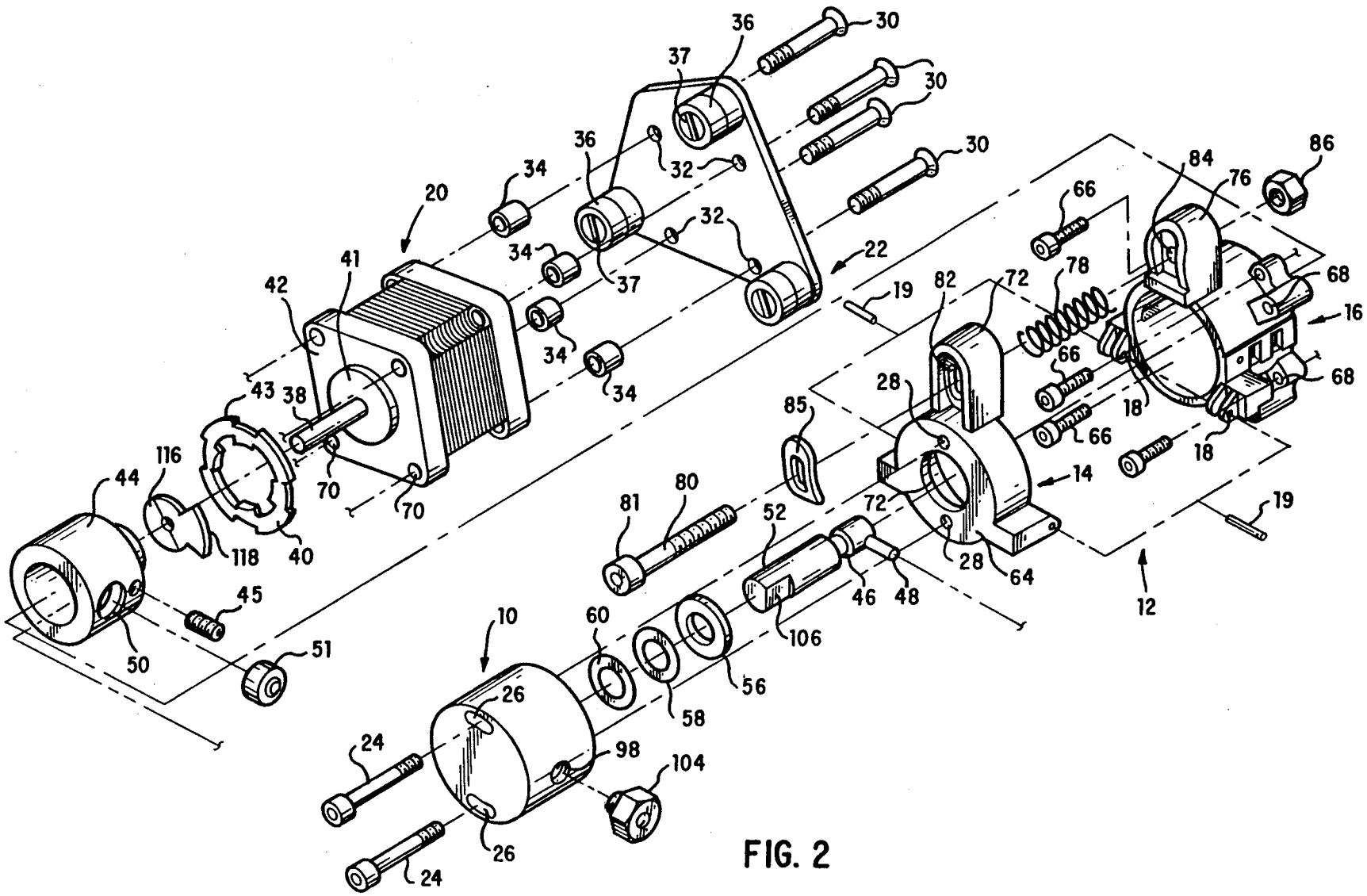
FIG. 2 is an exploded perspective view of the pump of FIG. 1.

As shown in FIG. 1 of the drawing, the valveless metering pump of the subject invention includes a head 10, a body 12 including an upper section 14 and a lower section 16 hingedly secured to one another at 18, a motor 20 and a support plate 22. As is best shown in FIG. 2, the head 10 is mounted on the upper section 14 of the body via mounting screws 24 which pass through clearance slots 26 provided in the head and are received by tapped holes 28 in the upper body section 14. The motor 20 is mounted on the support plate 22 by mounting screws 30 which pass through the clearance holes 32 provided in the support plate and through spacers 34 to be received by tapped holes (not shown) in the lower housing wall 35 of motor 20. Mounts 36 are located on the support plate 22 outside the perimeter of the motor 20 and include nested mounting screws 37 for mounting the assembled pump in an operating station (not shown).

The motor includes an elongate cylindrical drive shaft 38 which defines the drive axis of the pump. A locating ring 40 is secured to the front wall 42 of the motor housing and is positioned in axial alignment with the drive shaft 38 by the centering boss 41. The ring 40 includes an outer wall 43 which is adapted for receiving and centering the lower body section 16, as best seen in FIG. 3.

Figure 3:
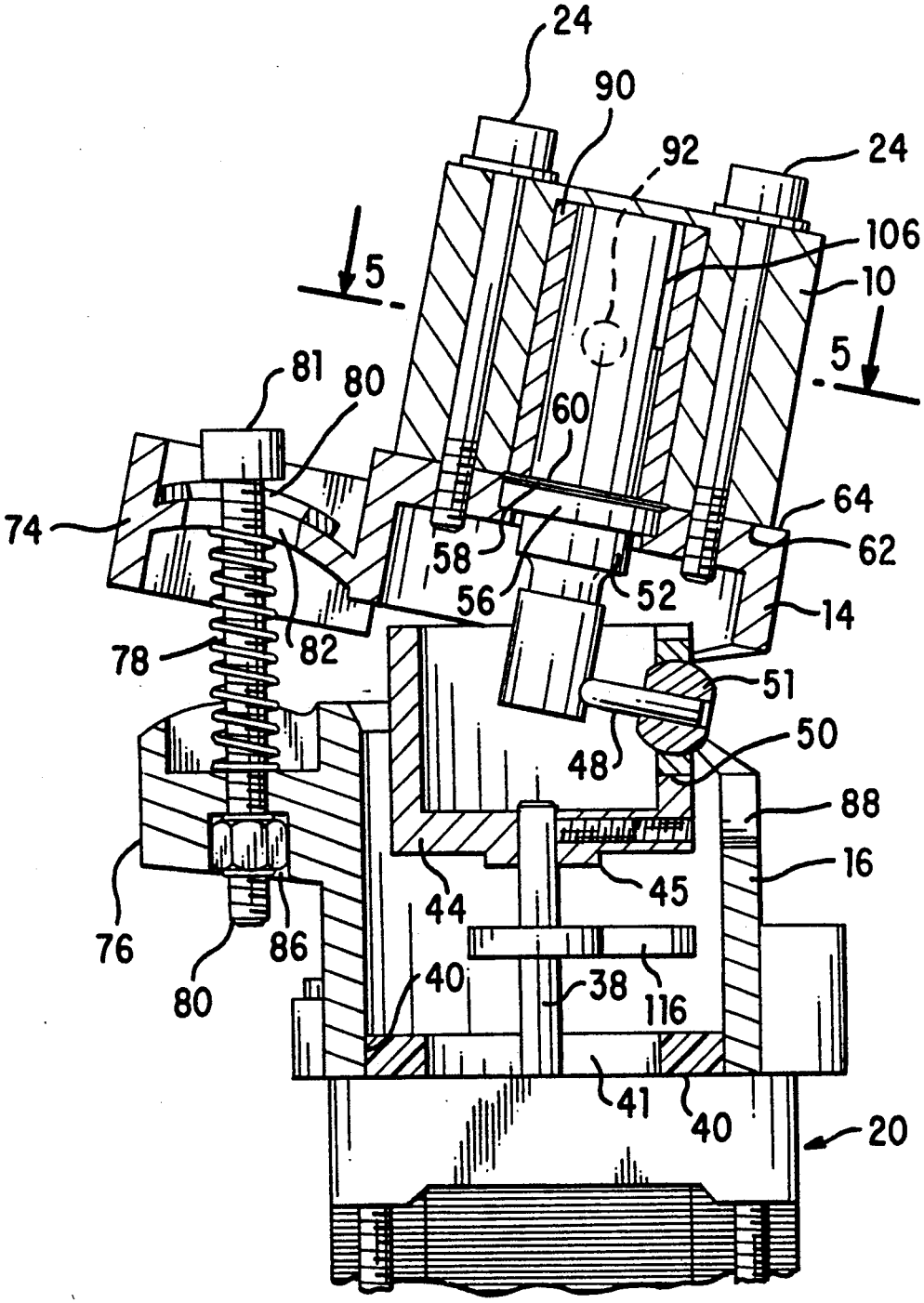
FIG. 3 is a partial side sectional view looking in the same direction as FIG. 1 and illustrating the interior chambers of the assembled pump with the piston at the maximum compression point of its stroke.

In the preferred embodiment, the hollow spindle 44 is secured on the end of shaft 38 by set screw 45 as best seen in FIG. 3. The spindle rotates in one-to-one relationship with the shaft for driving the piston 46.

The lower end of the piston 46 includes a drive pin 48. When the piston is properly mounted in the spindle 44, the drive pin 48 extends through the drive aperture 50 provided in the spindle, as best shown in FIG. 3. A spherical bearing 51 is placed in the aperture 50 for receiving the pin 48 and is movable in any direction relative to spindle 44 to permit free movement of the pin.

Figure 4:
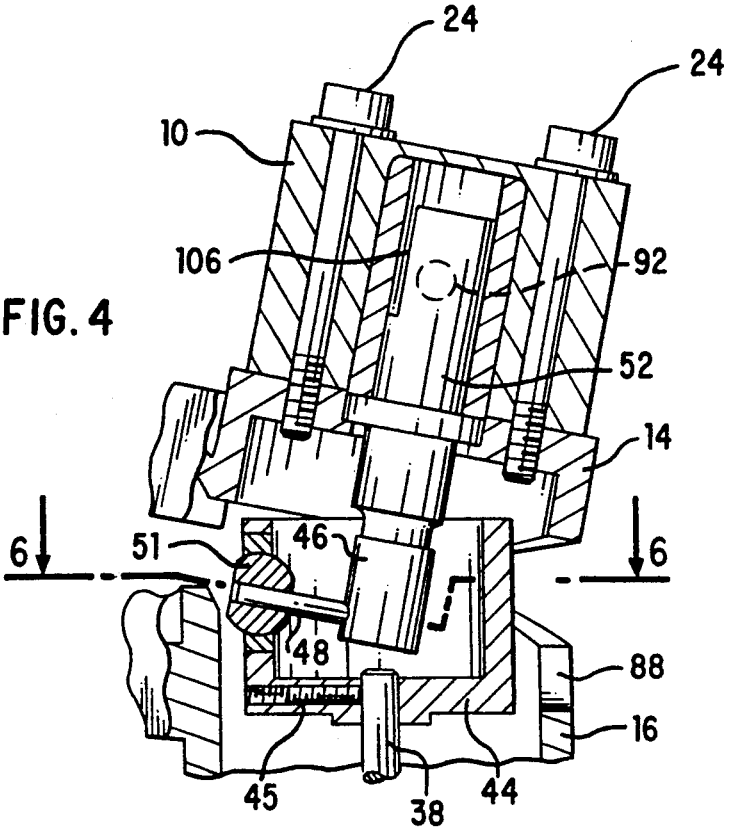
FIG. 4 is a partial side sectional view similar to FIG. 3 and illustrating the piston in the fully retract ed point of its stroke.

The head 52 of the piston 46 is received by the pump head 10 and closely conforms to the cylindrical inner side wall 55 of the working chamber 54, as best seen in FIG. 4. A series of seals 56, 58 and 60 are disposed between the lower bearing wall 62 (FIG. 3) of the pump head and the upper bearing surface 64 of the upper body section 14 of the pump body for sealing the pump head and piston against leakage.

The lower body section 16 is secured to the motor 20 via a plurality of mounting screws 66 which pass through clearance holes 68 provided in the lower body section and are received by tapped holes 70 in the upper wall 42 of the motor housing. When the lower body section 16 is properly seated on locating ring 40, the sleeve 44 is surrounded by and is coaxial and centered with the lower body section.

The upper body section 14 of the pump body is hingedly mounted on the lower body section at 18 via hinge pins 19. The head 52 of the piston extends through the clearance opening 72 in the upper body section and into the working chamber 54 of the pump head 10, as shown in FIG. 3. A slotted tab seat 74 is provided in the upper body section 14 and is located radially outward and diametrically opposite the center of the hinge axis. A complementary slotted tab seat 76 is provided on the lower body section 16. In the preferred embodiment, a compression spring 78 (FIG. 1) is disposed between seats 74 and 76 and a threaded adjustment screw 80 is passed through the slot 82 in seat 74, through the center of spring 78 and through the clearance slot 84 in seat 76. A slotted retainer 85 may be placed between the screw head 81 and the slotted seat 74 for properly maintaining the screw 80 in seat 74. A nut 86 is threadably received by the adjustment screw 80, whereby the angle of tilt between the upper body portion 14 and the head 10 relative to the lower body section 16 and the shaft 38 may be adjusted by turning screw 80 in nut 86.

As can best be seen in FIG. 1, the lower body section 16 includes a clearance slot 88 providing access to the set screw 45 for adjusting the position of spindle 44 relative to shaft 38. In addition, the elongate slots 26 in head 10 (FIG. 5) permit the rotational calibration of the angular relationship between the ports and the piston.

Figure 5:
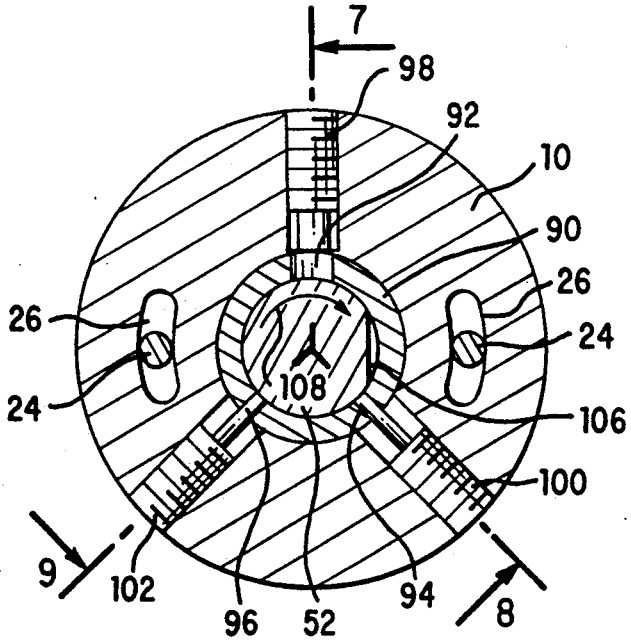
FIG. 5 is a sectional view taken along line 5—5 of FIG. 3, illustrating the relationship between ports, the pump working chamber and the piston.
Figure 6:
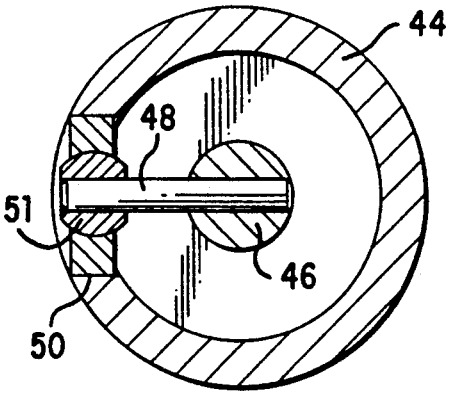
FIG. 6 is a sectional view taken along line 6—6 of FIG. 4, illustrating the relationship between the piston, the drive pin and sleeve.

In the preferred embodiment, the pump head 10 may be made of any suitable material and includes an inert insert 90 made of ceramics or the like which defines the accurately dimensioned inner cylindrical side wall 55 of the pump working chamber 54, as best illustrated in FIGS. 3 and 4. As shown in FIG. 5, the insert 90 includes three precisely metered, coplanar orifices 92, 94 and 96. The head 10 includes three corresponding cylindrical channels 98, 100 and 102. The channels 98, 100 and 102 may be tapped for receiving threaded couplings such as the coupling 104 (FIG. 2) for attaching the assembled pump to fluid control lines in the manner well known.

As is best shown in FIGS. 3 and 4, the tilt angle between the upper section 14 and the lower section 16 of the pump body controls the length of the reciprocating stroke of the piston 46. In FIG. 3, the piston 46 reaches its maximum height when the drive pin is diametrically opposite the adjusting screw 80 and, conversely as shown in FIG. 4, the piston reaches the low point of its stroke when the drive pin 48 is adjacent adjusting screw 80. The maximum height of the piston travel within the working chamber 54 is controlled by adjusting the position of the spindle 44 on the shaft 38 using set screw 45. When the drive motor 20 is activated to rotate the shaft 38, the piston rotates and reciprocates with sinusoidal motion in response to rotation of the spindle.

Thus, the fully assembled pump, as shown in FIGS. 1 and 3, may be calibrated to adjust the length of stroke of the piston by adjusting the tilt angle between the upper body section 14 and the lower body section 16 using adjustment screw 80. The working volume of the pump chamber 54 may be adjusted by positioning the spindle 44 on shaft 38 through use of set screw 45. In addition, the inlet and outlet ports in the head 10 may be angularly calibrated for balancing the input and output of the pump by adjusting the angular position of the head relative to the piston via mounting screws 24 and calibration slots 26, as best seen in FIG. 5.

Figure 7:
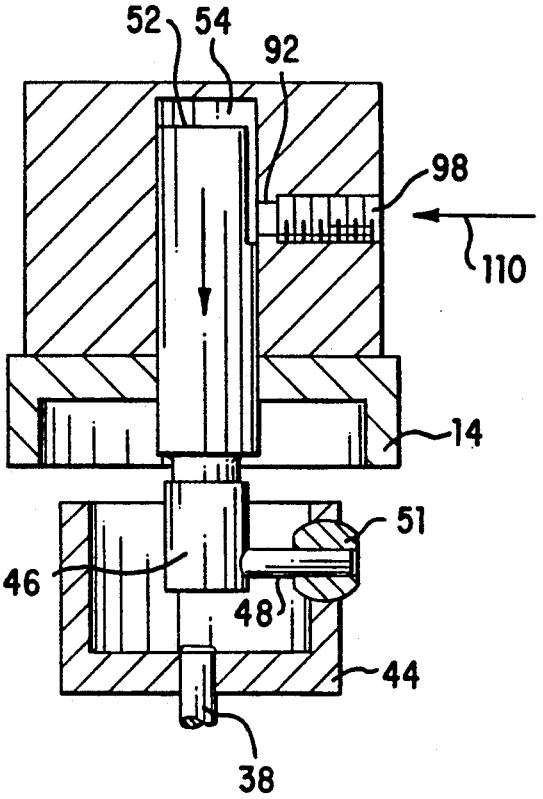
FIG. 7 is a diagrammatic sectional view looking generally along line 7—7 of FIG. 5, illustrating the relationship between the piston and the inlet port as fluid is being drawn into the pump chamber.
Figure 8:
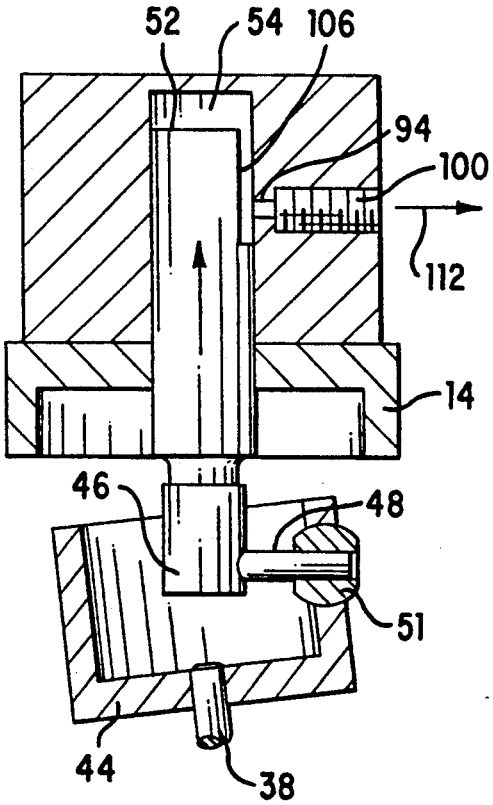
FIG. 8 is a diagrammatic sectional view looking generally along line 8—8 of FIG. 5, illustrating the relationship between the piston and one outlet port as fluid is being dispensed therethrough.
Figure 9:
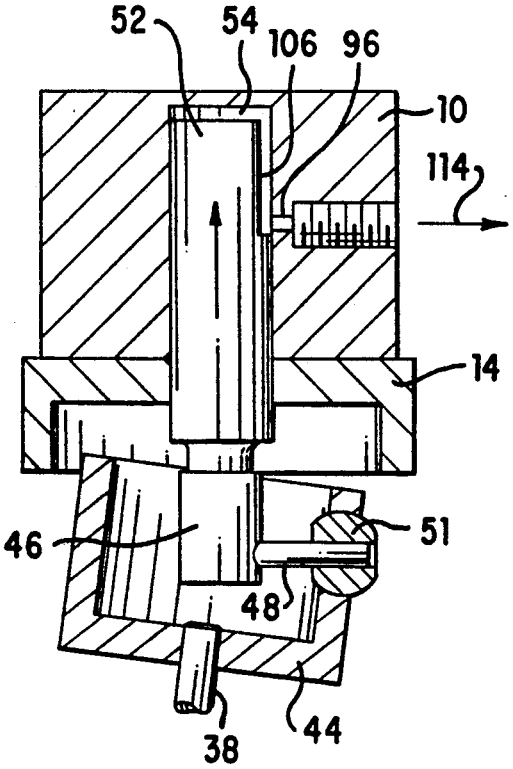
FIG. 9 is a diagrammatic sectional view looking generally along line 9—9 of FIG. 5, illustrating the relationship between the piston and the other outlet port as fluid is being dispensed therethrough.

It will be noted that the piston includes a flat or duct 106 in the cylindrical outer wall of the head 52. As is shown in FIG. 5, when the piston rotates in the direction of arrow 108 it is moved sequentially from inlet port 92 past outlet port 94 and outlet port 96 and back to inlet port 92. As is shown in FIG. 7, the piston is entering its downstroke as it comes into contact with inlet port 92, thereby expanding the working chamber 54 to draw fluid in through the channel 98 and inlet port 92, as indicated by arrow 110. As the piston continues its rotation, it begins its upstroke as it comes in contact with the first outlet port 94, contracting the working chamber 54 for forcing a portion of the fluid out through the first outlet port 94 and associated channel 100 as indicated by arrow 112. The piston continues its upstroke as it moves into contact with the second sequential outlet port 96, further contracting the working chamber 54 and forcing additional fluid out through port 96 and the associated channel 102, as indicated by arrow 114. As the piston moves past port 96, it enters the peak of its upstroke and begins the next downstroke as it moves into contact with port 92 for again drawing fluid into the working chamber of the pump. It has been found that the-fluid flow through the outlet ports 4 and 96 can be accurately balanced by adjusting the angular position of the ports relative to the stroke of the piston by rotating the head within the range permitted by the slots 26. In the preferred embodiment, the outlet ports may be adjusted to within less than a one percent coefficient of variance for reagent fluids dispensed in the range of 1-100 microliters. Further, the reagents have been consistently dispensed within a plus or minus 0.5 microliter accuracy and precision.

As is shown in FIGS. 2 and 3, a flag 116 may be mounted on shaft 38. The flag 116 includes a radially projecting indicator tab 118 which permits accurate continuous reading of the angular position of the piston 46. An optical or other type of sensor (not shown) can be disposed in communication with the indicator tab 118 of the flag. Where increased accuracy and balancing is desired, the flag and indicator can be used to control the speed of motor 20 as it rotates through its cycle, altering the speed of rotation and reciprocation of the piston to increase and/or decrease pressure, as desired, to further control the flow of fluid through the ports 92, 94 and 96.

The valveless, positive displacement metering pump of the invention, as herein described, is particularly useful for dispensing reagent fluids in minute, accurate volumes into a test sample for assay testing. It will readily understood that the features of the pump make it readily adaptable to a variety of other applications. While certain features and embodiments of the invention have been described in detail herein, it will be understood that the invention includes all enhancements and modifications thereof as more distinctly pointed out in the claims which follow.

What is claimed is:

1. A valveless metering pump comprising:

a. a head including a cylindrical working chamber and a plurality of angularly spaced, coplanar channels intersecting said working chamber for defining inlet and outlet ports;

b. a piston in said working chamber and including a substantially cylindrical outer surface corresponding to said working chamber, the piston including a fluid duct defined by the outer surface of the piston;

c. a motor having a shaft for defining a drive axis;

d. a hollow spindle coaxial with the drive axis and rotatably mounted on the shaft;

e. means for securing the piston to the spindle such that the spindle and piston rotate in one-to-one relationship with the shaft;

f. a body encasing the piston and spindle and disposed between the motor and head, said body having an upper section secured to the head and a separate lower section secured to the motor, and means for hingedly securing the body sections relative to one another whereby the angular orientation of the axis of the head relative to the shaft may be altered;

g. means associated with the head for adjusting the rotational orientation of the channels relative to the body;

h. means associated with the body for adjusting the angular orientation of the axis of the head relative to the shaft; and i. means associated with the spindle for adjusting the axial position of the spindle relative to the shaft.

2. The valveless metering pump of claim 1, wherein the adjustment means associated with the body further includes:

a. a seat in the first body section having a through clearance opening therein;

b. a threaded set screw in said clearance opening; and c. a receiving seat in the second body section including a tapped element for receiving said screw.

3. The valveless metering pump of claim 2 wherein the adjustment means associated with the body further includes biasing means placed between said seat and said receptacle for continuously urging the seat and receptacle away from one another.

4. The valveless metering pump of claim 1 wherein the means for hingedly securing the upper and lower body sections is displaced radially outward from the drive axis of the pump.

5. The valveless metering pump of claim 4 wherein the means for adjusting the angular orientation of the axis of the head is also displaced radially outwardly from the drive axis of the pump and is diametrically opposite the center of the hinge means.

6. A valveless metering pump comprising:

a. a head including a cylindrical working chamber and a plurality of angularly spaced, radially extending channels intersecting said working chamber for defining inlet and outlet ports;

b. a piston in said working chamber and including a substantially cylindrical outer surface corresponding to said working chamber, the piston including a fluid duct defined by the outer surface of the piston;

c. drive means for simultaneously rotating and axially reciprocating the piston in the working chamber for passing the fluid duct of the piston into sequential communication with each of said channels, wherein said drive means includes a shaft having a longitudinal drive axis about which the piston rotates;

d. means for adjusting the reciprocating stroke of the piston comprising:

i. a pump body disposed between the pump head and the drive means and including a first body section secured in axial relationship relative to said head and a second body portion secured in fixed axial relationship relative to said drive axis;

ii. hinge means for securing the first body section to the second body portion in a pivotable relationship with one another comprising a hinge pin with an axis displaced radially outward from the drive axis of the pump; and iii. means associated with said body for adjusting the angular relationship of the first body portion relative to the second body portion comprising means for altering the angular orientation of one hinged body portion relative to the other hinged body portion, wherein said adjusting means is displaced radially outward from the said drive axis of the pump and is diametrically opposite the center of the hinge means; and e. means for adjusting the angular relationship of the work chamber channels with respect to the fluid duct of the piston at the start of its upward stroke.

7. A valveless metering pump comprising:

a. a head including a cylindrical working chamber and a plurality of angularly spaced, radially extending channels intersecting said working chamber for defining inlet and outlet ports;

b. a piston in said working chamber and including a substantially cylindrical outer surface corresponding to said working chamber, the piston including a fluid duct defined by the outer surface of the piston;

c. drive means for simultaneously rotating and axially reciprocating the piston in the working chamber for passing the fluid duct of the piston into sequential communication with each of said channels, wherein said drive means comprises:

i. a motor having a rotating shaft;

ii. means for securing the piston relative to the shaft for one-to-one rotation therewith; and iii. means in communication with the piston for simultaneously generating a reciprocating motion of the piston as it is rotated by said shaft;

d. means for adjusting the reciprocating stroke of the piston comprises means associated with the piston for tilting the axis of the piston relative to the axis of the spindle;

3. means for adjusting the angular relationship of the work chamber channels with respect to the fluid duct of the piston at the start of its upward stroke; and piston engaging means comprising:

i. a hollow spindle coaxial with the drive axis of the pump, said spindle rotatably mounted on the shaft and adapted for enveloping said piston;

ii. a spherical bearing mounted in said spindle;

iii. a drive pin extending radially outwardly from the piston and received by said spherical bearing; and iv. means associated with said spindle for adjusting the axial position of the sleeve relative to the shaft.

8. A valveless metering pump comprising:

a. a head including a cylindrical working chamber and a plurality of angularly spaced, radially extending channels intersecting said working chamber for defining inlet and outlet ports;

b. a piston in said working chamber and including a substantially cylindrical outer surface corresponding to said working chamber, the piston including a fluid duct defined by the outer surface of the piston;

c. drive means for simultaneously rotating and axially reciprocating the piston in the working chamber for passing the fluid duct of the piston into sequential communication with each of said channels, wherein said drive means includes a shaft having a longitudinal drive axis about which the piston rotates;

d. means for adjusting the reciprocating stroke of the piston comprising:

i. a pump body disposed between the pump head and the drive means and including a first body section secured in axial relationship relative to said head and a second body portion secured in fixed axial relationship relative to said drive axis;

ii. hinge means for securing the first body section to the second body portion in a pivotable relationship with one another; and iii. means associated with said body for adjusting the angular relationship of the first body portion relative to the second body portion comprising (a) a seat in the first body section having a through clearance opening therein; (b) a threaded set screw in said clearance opening; (c) a receiving seat in the second body section including an element for receiving said screw; and (d) biasing means placed between said seat and said receiving seat for continuously urging the seat and receiving seat away from one another; and e. means for adjusting the angular relationship of the work chamber channels with respect to the fluid duct of the piston at the start of its upward stroke.

* * * * *

UNITED STATES PATENT AND TRADEMARK OFFICE

CERTIFICATE OF CORRECTION

PATENT NO. : 5,246,354

DATED : September 21, 1993

INVENTOR(S) : Guillermo P. Pardinas

It is certified that error appears in the above-identified patent and that said Letters Patent is hereby corrected as shown below:

Column 3, line 28, change "fully retract ed point" to -- fully retracted point --.

Column 5, line 59, change "found that the-fluid" to -- found that the fluid --.

Column 5, line 59, change "outlet ports 4 and " to -- outlet ports 94 and --.

Column 7, line 9, change "radially outwardly" to -- radially outward --.

UNITED STATES PATENT AND TRADEMARK OFFICE

CERTIFICATE OF CORRECTION

PATENT NO. : 5,246,354 Page 2 of 2

DATED : September 21, 1993

INVENTOR(S) : Guillermo P. Pardinas

It is certified that error appears in the above-indentified patent and that said Letters Patent is hereby corrected as shown below:

Column 8, line 11, change "3. means for adjusting to --e.menas for adjusting --.

Column 8, line 15, change "piston engaging means comprising:" to --f. piston engaging menas comprising: --.

Signed and Sealed this

Twelfth Day of April, 1994

*Attest:*

Bruce Lehman

BRUCE LEHMAN

*Attesting Officer*

*Commissioner of Patents and Trademarks*